United States Patent [19]

Murauchi

[11] Patent Number: 4,754,270

[45] Date of Patent: Jun. 28, 1988

[54] APPARATUS FOR VARYING THE SIZE AND SHAPE OF AN IMAGE IN A RASTER SCANNING TYPE DISPLAY

[75] Inventor: Akitsugu Murauchi, Osaka, Japan

[73] Assignee: Nintendo Co., Ltd., Kyoto, Japan

[21] Appl. No.: 700,622

[22] Filed: Feb. 12, 1985

[30] Foreign Application Priority Data

Feb. 16, 1984 [JP] Japan ..... 59-28193
Apr. 9, 1984 [JP] Japan ..... 59-71625

[51] Int. Cl.[4] ..... G09G 1/16

[52] U.S. Cl. ..... 340/731; 340/729; 340/735; 340/747

[58] Field of Search ..... 340/731, 749, 747, 728, 340/735, 729

[56] References Cited

U.S. PATENT DOCUMENTS

| | | | |
|---|---|---|---|
| 3,638,216 | 1/1972 | Brewster | 340/735 |
| 3,786,477 | 1/1974 | Baumgartner | 340/735 |
| 3,958,232 | 5/1976 | Hobrough et al. | 340/735 |
| 4,107,665 | 8/1978 | Mayer et al. | 340/731 |
| 4,242,678 | 12/1980 | Somerville | 340/728 |

*Primary Examiner*—Marshall M. Curtis
*Attorney, Agent, or Firm*—Larry A. Jackson

[57] ABSTRACT

A displaying apparatus using a raster scanning type display such as a CRT, wherein vertical and horizontal positions are addressed respectively by an address counter for displaying an image stored in a character memory containing a matrix of horizontal and vertical dot information. Start address data, for locating the position of the image on the display, is loaded into vertical address and horizontal address counters which are then incremented by a carry output from horizontal and vertical adders respectively associated with the horizontal and vertical counters. The adder for the vertical address counter repeats adding operations according to predetermined addend data four times in one horizontal blanking period and twice in one vertical blanking period. The adder for the horizontal address counter repeats adding operations according to predetermined addend data at intervals selected to be a fraction, e.g. ¼th, the usual horizontal dot interval. By appropriate setting of the addend data, the size of characters and the associated images on a CRT screen can be enlarged or reduced with respect to a nominal size. Moreover, the start address and addend data described above are renewed at the beginning of every horizontal line so that the characters images can be displayed at skewed angles, such as in a perspective view.

26 Claims, 5 Drawing Sheets

APPARATUS FOR VARYING THE SIZE AND SHAPE OF AN IMAGE IN A RASTER SCANNING TYPE DISPLAY

BACKGROUND OF THE INVENTION

1. Field of the Invention

The present invention relates to a displaying apparatus. More specifically, the present invention relates to a displaying apparatus using a raster scanning type display, for example, such as a CRT display and similar devices.

2. Description of the Prior Art

Displaying apparatus capable of changing sizes of an object displayed are on a screen or a display disclosed in, for example, Japanese Patent Publication No. 45225/1980 published on Nov. 17, 1980 corresponding to U.S. Pat. No. 4,107,665. The prior art uses a VCO (Voltage Controlled Oscillator), an oscillation frequency of the VCO is changed in response to a data from a CPU and an address counter is incremented synchronously with an oscillation output. Accordingly, the higher the oscillation frequency of the VCO, the smaller the object displayed on the screen. Conversely, the longer an oscillation period of the VCO, the longer the addressing time, accordingly the size of the object is enlarged. In the prior art, thus, the size of object displayed is changed by varying the oscillation frequency of the VCO. Such technique may be applied, for example, advantageously in a TV game equipment.

However, in the prior art described above, since an analog circuit element such as the VCO is used, an exacting frequency control is required. Moreover, since a charge/discharge circuit having a capacitor is included, there was a difficulty not only of adjusting a value of the capacitor, etc. but also in fabricating such capacitive circuit in a large scale integrated circuit (LSI). Furthermore, since a changing rate of the frequency of the VCO is exactly the ratio of image enlargement and reduction and the range of the frequency rate change is limited by the capacitor circuit, the enlargement and reduction ratio can not be increased much.

An alternative proposal using the above cited large scale integrated circuit, it might be possible to use a digital circuit including a reference oscillator and a programmable frequency divider in place of the VCO for generating a clock signal for an address counter. That is, a count input having various frequencies as in the prior art described above is obtainable by dividing an output of the reference oscillator in accordance with a division ratio from the CPU.

However, according to calculations made by the inventor of the present invention, a frequency of the reference oscillator of more than 3 GHz is required for obtaining a performance similar to the prior art by the configuration described above, but such an oscillator is not readily obtainable in practice. Further, a response speed of the programmable frequency divider must be in the range of about 325 pico-seconds, but such a high response speed in a programmable frequency divider is, practically, not available. Accordingly, the digital circuit cannot be implemented merely by using the concept taught by the prior art cited above.

SUMMARY OF THE INVENTION

Therefore, it is a principal object of the present invention to provide a novel displaying apparatus using digital processing to vary the size (zoom control) of a video image.

It is another object of the present invention to provide a digitized displaying apparatus which is capable of enlarging or reducing a display size.

It is a further object of the present invention to provide a displaying apparatus which is capable of enlarging or reducing a display image size and in which the enlarging or reducing ratio can be freely selected.

It is still another object of the present invention to provide a displaying apparatus which is suitable for generating a perspective display.

It is a further object of the present invention to provide a video displaying apparatus which that uses a digital circuit suitable for being fabricated as an integrated circuit.

In brief, the present invention is a displaying apparatus which generates address correlation data of a memory means by numerical calculation in response to calculating the prescribed input numerics.

A novel displaying apparatus is made from a simple circuit that enables variations of characters or images on a display screen in various ways.

In the preferred embodiment of the present invention, address calculations are performed on the basis of an initial value data related to an address and data determining an enlarging or reducing ratio. Calculated address data is then applied to display memory means, for example, a character ROM.

According to the embodiment, since the address data for a display is obtained by receiving the initial value data related to the address and the ratio data, for example, from the CPU and calculating thereof digitally the whole circuits can be digitized. Accordingly, not only a delicate control the CPU, the calculations thereof can be performed digitally and the required circuits can be digitized. Accordingly, not only can the exacting control circuitry of the prior art be omitted, but also the preferred configuration can be easily fabricated as a large scale integrated ciruit.

Furthermore, the enlarging or reducing ratio of the display size can be freely decided by selecting the ratio data to be provided. Also, there are scarcely any restrictions imposed by other circuit components, such as in the case of the VCO of the prior art cited.

In other preferred embodiment of the present invention, the address data are generated from renewed data obtained from renewing the start address and an addend for example, renewal of data occurs at every horizontal scanning of the display on the basis of the start address and an increment thereof, and the addend and increment thereof. According to this embodiment, excessive load on a control means such as the CPU is prevented even when displaying images perspectively by changing angles or points of view. Accordingly, both the calculation of address data and other control data, for example, the control of game operations, can be performed by one CPU. Moreover, varied perspective displays are possible by just changing the data that determine image size and shape.

These objects and other objects, features, aspects and advantages of the present invention will become more apparent from the following detailed description of the present invention when taken in connection with the accompanying drawings.

DESCRIPTION OF THE PREFERRED EMBODIMENTS

Figure 1:
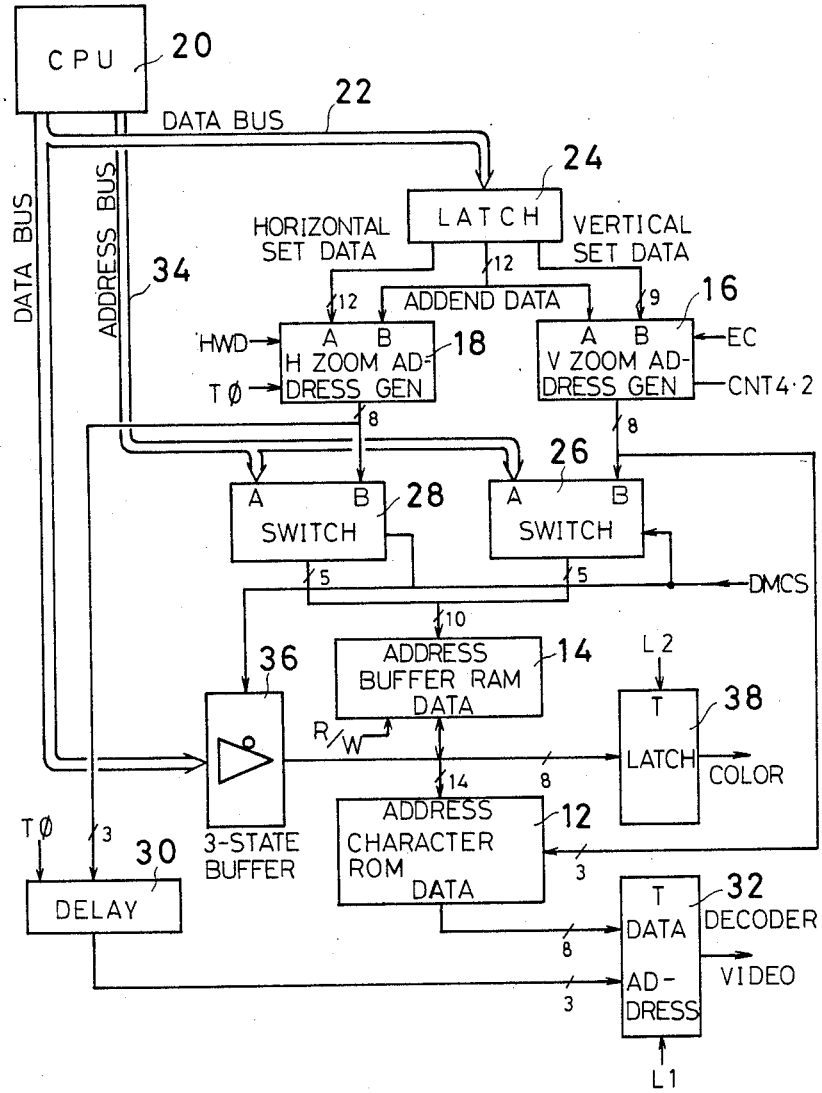
FIG. 1 is a block diagram showing an embodiment of the present invention.

FIG. 1 is a block diagram showing one embodiment of the present invention. First, the basic concept of the embodiment will be described briefly.

In general, for TV game equipment, a raster scanning type display such as a CRT display display is used. When using the CRT display, a screen is divided in picture elements in an array of 256×256 dots. Accordingly, a character consisting of 8×8 dots can be displayed on a screen in as many as 32×32=1024 locations. When the circuit configuration uses a character ROM 12 and a buffer RAM 14 as shown in FIG. 1, the buffer RAM 14 will have 32×32 addresses and one address of the buffer RAM 14 corresponds to one character of 8×8 dots. That is, the address of the buffer RAM 14 corresponds to a position on the screen of the display. When a character is required to be displayed in a position on the screen, a character number thereof stored in the character ROM 12 must be stored in one address of the buffer RAM 14 corresponding thereto. Then, during horizontal scanning on the display, one address of the buffer RAM 14 is selected and one byte at every horizontal scanning is read out from the character ROM 12 as the display data.

On the contrary, in the embodiment, a screen of a display such as a CRT display is divided in picture elements having 1024 dots in a horizontal direction and 256 dots in a vertical direction. Accordingly, the horizontal direction is divided in dots four times as many as the former case. Meanwhile, the character ROM 12 stores the display data of one character in 8×8 bits as usual. The buffer RAM 14 also has a capacity of 32×32 as usual and each address thereof corresponds to the position on the screen of the display. In the embodiment, the horizontal address of the buffer RAM 14 is renewed at every 50 nanoseconds and the vertical address thereof is renewed four times in one horizontal blanking period and twice in one vertical blanking period. Accordingly, if the horizontal address of the buffer RAM 14 is incremented by "1" at every 50 nanoseconds as usual a size in a horizontal direction displayed on the screen of the display will be reduced to a quarter (=256/1024) of the former one. Meanwhile, since the vertical address is also incremented four times in one horizontal blanking period, if the increment is "1" at a time as usual a size in a vertical direction displayed on the screen of the display will be also reduced to a quarter.

Accordingly, in the embodiment, the number of vertical scanning lines and horizontal dot sizes on the screen of the display will be changed by setting the vertical address and horizontal address of the buffer RAM 14 in response to the vertical zoom address generator 16 and the horizontal zoom address generator 18.

Figure 2:
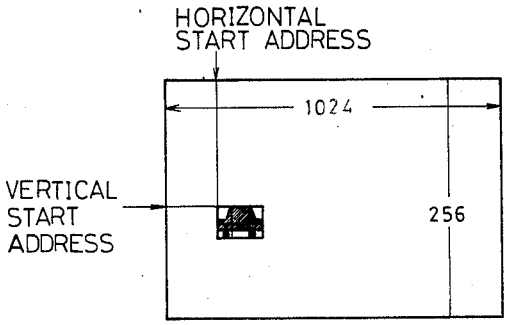
FIG. 2 is an illustrated view showing an example of a display image for illustrating the basic concept of the embodiment.

Referring to FIG. 1, the CPU 20 comprises a digital data processing means of a microprocessor or a microcomputer, for example, such as "Z80A" by Zilog. If this circuit is used in a TV game equipment, an operating means, for example, such as a joy stick will be connected to the CPU 20. The CPU 20 performs a necessary calculation in accordance with the operation of such operating means and provides data to a latch circuit 24 via a data bus 22. The latch circuit 24, may for example, be a "74LS373", by Texas Instruments. Data provided to the latch circuit 24 from the CPU 20 are vertical set data, horizontal set data and addend data. The vertical set data and the horizontal set data are data for the initial values related respectively with a vertical start address and a horizontal start address on the screen of the display as shown in FIG. 2. That is, the CPU 20 decides respective start addresses by deciding where to display a character or a picture in accordance with the operation of the operating means of the joy stick, etc. (not shown), connected to the CPU 20. The CPU 20 provides the set data according to the start addresses.

The vertical set data from the latch circuit 24 is provided to the vertical zoom address generator 16 as nine bits data and the addend data is provided to the vertical zoom address generator 16 and horizontal zoom address generator 18 as twelve bits data via the latch circuit 24. The horizontal set data is provided to the horizontal zoom address generator 18 as twelve bits data. Furthermore, in the embodiment, the same addend data are given to the vertical zoom address generator 16 and the horizontal zoom address generator 18. However, it is apparent that the different addend data can be provided to the vertical and horizontal zoom address generators respectively. Then more varied characteristics or pictures may be displayed.

The vertical address from the vertical zoom address generator 16 is provided to one input of a switch circuit 26, for example, as the eight bits (but changes corresponding to the capacities of the character ROM 12 and buffer RAM 14) address data. The least significant three bits of the vertical address is provided to the character ROM 12 as the signal for selecting a row (one byte) of the character ROM. For example, integrated circuit "27128" by Intel may be used for character ROM 12. The horizontal address from the horizontal zoom address generator 18 is provided at one input of a switch circuit 28 as the eight bits (but changes corresponding to the capacities of the character ROM 12 and buffer RAM 14) address data. The least significant three bits of the horizontal address is provided to a decoder 32 as an address of a parallel-serial conversion of the decoder 32 through a delay circuit 30 comprising a shift register, for example, such as "74LS164" by Texas Instruments. The decoder 32 is a 8-1 decoder with a data latch, for example, such as "74LS357" by Texas Instruments which latches the display data from the character ROM 12 in response to a latch timing signal L1. Meanwhile, as the switch circuits 26 and 28, for example, may be provided by integrated circuits "74LS157" from Texas Instruments.

To other inputs of the switch circuits 26 and 28, the address data from the CPU 20 are provided respectively via the address bus 34. In the switch circuits 26 and 28 an input A or B is switched by a signal DMCS which is a direct memory access signal in a vertical blanking period and is provided, for example, from the CPU. For example, when the signal DMCS is "0" the input A, namely the address data from the CPU 20 is provided to the buffer RAM 14 and when the signal DMCS is "1" the input B address data from the respective zoom address generators 16 and 18 are provided to the buffer RAM 14 which consist of, for example, "6116" by Fujitsu.

The signal DMCS is, further, provided as a control signal for a tri-state buffer 36 such as "74LS367" by Texas Instruments. A data from the CPU 20 is provided to the tristate buffer 36 through the data bus 22 and this data indicates which character number of the character ROM 12 should be displayed on the screen in the position corresponding to each address of the buffer RAM 14. Accordingly, when the signal DMCS in the vertical blanking period is "0" in the buffer RAM 14, the character number data is stored through the tri-state buffer 36 in the address selected by the address data provided via the A inputs of switch circuits 26 and 28 respectively. At this time, a color code which indicates a display color of the character with that character number is also stored in the address of the buffer RAM 14.

A color code signal from the buffer RAM 14 is provided to the latch circuit 38 as the eight bits signal. This latch circuit 38 latches the color code in response to the latch timing signal L2. Moreover, a display data of each one byte from the character ROM 12 is provided to the decoder 32 as described above. Accordingly, a video signal can be obtained from the decoder 32 and the color signal can be obtained from the latch circuit 38. By these video signal and color signal the raster scanning type display such as CRT (not shown) display can be displayed.

Next, in reference to FIG. 3, the vertical zoom address generator 16 will be described in detail. The vertical zoom address generator 16 comprises an address counter 161 such as, for example, "74LS161" by Texas Instruments which is incremented by receiving a carry (carrying signal) Cn from an adder 162 provided to a count input IN thereof. A vertical set data from a latch circuit 24 (FIG. 1) is provided to the address counter 161 in parallel bits which is set as the initial value of the address counter 161. The address counter 161 has a nine bits configuration to count "256" and the most significant one bit thereof is provided as a vertical display control signal. Remaining eight bits of the address counter 161 are given to the switch circuit 26 (FIG. 1) as the vertical zoom address. A signal EC is provided to a terminal PL of the address counter 161 as well as a terminal R of the latch circuit 163 comprising, for example, "74LS373" by Texas Instruments. The signal EC is a signal which is outputted once in the vertical blanking period as shown in FIG. 4. Signals CNT4/CNT2 are provided to a trigger input of the latch circuit 163. The signal CNT4 is, as shown in FIG. 4, a pulse signal which is outputted four times for each signal HWD during the horizontal blanking (H-BL) period and the signal CNT2 is a pulse signal which is outputted out twice during the signal EC described above. Further, the signal HWD is a window pulse which is provided in the horizontal blanking period and continues for about 1.2 microseconds. The latch circuit 163 latches data from an addend value output terminal Σ of the adder 162 in response to such latch trigger signals CNT4/CNT2 and a latch output Q is provided again to one input B of the adder 162. An addend data from the latch circuit 24 (FIG. 1) is provided to another input A of the adder 162. As the adder 162, for example, "74LS283" by Texas Instruments may be available. These adder 162 and latch circuit 163 have 12 bits configuration respectively. Furthermore, the signals CNT4/CNT2 are provided to the latch circuit 163 (see FIG. 4) to cause the adding operations to be performed four times in the horizontal blanking period and twice in the vertical blanking period because the ratio of the dot number of the screen is 1024/256 and because of the interlaced scanning.

Further, the signals HWD and EC can be generated, for example, by a ROM. That is, codes for these HWD and EC signals are stored in prescribed addresses of the ROM (not shown) in advance, then as the ROM is addressed by the horizontal and vertical counters (not shown), the codes will be read out from the ROM and decoded and the signals HWD and EC obtained. Furthermore, the signal CNT4 can be generated by a digital differential circuit triggered by the signal HWD, and the signal CNT2 can be generated by a digital differential circuit triggered by the signal EC respectively. For the signal T0, for example, a quartz oscillator (not shown) having a frequency of 20 MHz may be provided.

For displaying a picture of automobile on the display as shown in FIG. 2 if the vertical start address is, for example, "100", the vertical set data, as the initial value of the address counter 161, will be set at a numeric "156" to register "256" when the address counter 161 counts "100". If the addend data is, for example "0.25" a carry Cn is obtained when the adder 162 performs four adding operations. That is because the adder 162 performs the following addition operations, "0.25+0", "0.25+0.25", "0.5+0.25", "0.75+0.25", "1.0+0.25", resulting in a carry of "1" for the last add operation. Accordingly, the vertical zoom address from the address counter 161 is incremented by "1" (to move the display character one vertical dot) in one horizontal blanking period and by "0.5" in one vertical blanking period (to accommodate interlace scanning) when the addend data has been set as "0.25". Accordingly, in the following vertical scanning period, called the interlaced scanning interval, the raster displays horizontal scanning lines scanned in a previous vertical scanning period.

The increment of vertical zoom address by "1" in one horizontal blanking period is as same as usual, accordingly when the addend data "0.25" has been set, a picture or a character of original size is displayed on the screen of the display. When the addend data is set at "0.15", the vertical zoom address will be incremented by "1" after six horizontal blanking periods, accordingly a dot size in a vertical direction displayed on the display is enlarged by 1.6 times. When the addend data is given as "0.5", the vertical zoom address will be incremented by "2" in one horizontal blanking period. Accordingly, by selecting the addend data properly, a size of the picture or character on the display in the vertical direction can be reduce or enlarged or the original size can be displayed.

The increment of the vertical address by "1" in one horizontal blanking period means that the vertical address of the buffer RAM 14 varies at every one horizontal scanning and the display data from the character ROM 12 is renewed at every one horizontal scanning. Such renewal of the display data at every one horizontal scanning is as same as usual, accordingly, a size in the vertical direction keeps the original size. However, if the vertical address of the bufer RAM 14 is stepped less than "1" the same display data will be provided from the character ROM 12 for more than one horizontal scanning period which consequently enlarges the size of the picture or character to be displayed in the vertical direction. Conversely, if the vertical address of the buffer RAM 14 is stepped more than "1" in one horizontal blanking period, the display data from the character ROM 12 will be jumped. This causes the size in the vertical direction of the picture or character displayed on the display to be compressed or reduced.

Next, referring to FIG. 5, the horizontal zoom address generator 18 will be described in detail. The horizontal zoom address generator 18 also comprises the address counter 181 which consists of, for example, "74LS161" by Texas Instruments and has a 10 bits configuration so as to be able to count up to "1024".

Figure 6:
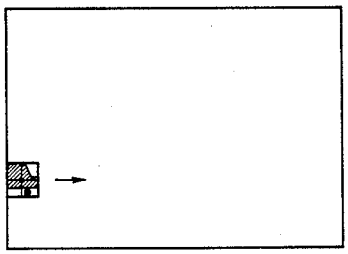
FIG. 6 shows an example of a display image for illustrating a horizontal zoom address generator.

The carry Cn from the adder 162 which consists of, for example, "74LS283" by Texas Instruments is provided to the count input IN of the address counter 181. The output from the most significant two bits of the address counter 181, i.e. the ninth and tenth bits, are taken out in an OR manner as the horizontal display control signal. A latch circuit 183 consists of, for example, "74LS183" by Texas Instruments, has a twelve bits configuration and receives T0 as a latch trigger signal. The signal T0 is a signal having a 50 nano-seconds (=51.2 microsecond/1024) period. A latch output Q of the latch circuit 183 is again provided to one input of an adder 182 and an addend data from the latch circuit 24 (FIG. 1) is provided to another input-thereof. An added output Σ of the adder 182 is provided to the latch circuit 183. Further, horizontal set data from the latch circuit 24 is provided to the address counter 181 as an initial value data thereof and an output of the address counter 181 is provided as a horizontal zoom address through the switch circuit 28 as the horizontal address of the buffer RAM 14. Furthermore, a horizontal window pulse HWD is provided to a terminal PL of the address counter 181 and a terminal R of the latch circuit 163 and these circuits 181, 183 and 184 are reset at every one horizontal scanning. The 2 bits of horizontal set data representing values to the right (under) the decimal point are provided to a decoder 184 which consists of, for example, "74LS139" by Texas Instruments, and an output thereof is provided to R/S inputs of flip-flops 183*a* which function as the least significant two bits of the latch circuit 183. For example, if each of two bits of the decoder 184 is "1", binary data "11" corresponding to "0.75", and consisting of two digits under the decimal point, is provided from the flip-flops 183*a*. The reason for using a numerical value of two digits under decimal point is for ensuring smooth variations when, for example, displaying part of the body of an automobile which is to first be displayed and then moved step by step in full view as shown in FIG. 6. The flip-flop 183*a* may be provided by "74LS74" from Texas Instruments. Moreover, in the example two bits representing a value under decimal points are used, but for smoother variations more than three bits may be used.

When displaying a picture of an automobile as shown in FIG. 2, a horizontal start address may be, for example "100". Accordingly, for the horizontal set data, a numeric "924" is provided as an initial value data, whereby the address counter 181 is reset after counting "100" (924+100=1024) and starts again. If, for example, "0.25" is provided from the latch circuit 24 (FIG. 1) as an addend data, the adder 162 performs adding operations in response to the signal T0 at every 50 nanoseconds and provides the carry Cn at every 200 nanoseconds. Accordingly, the horizontal address from the address counter 181 is incremented by "1" at every 200 nanoseconds. As such, one dot size in the horizontal direction of 200 nano-seconds is the same as a size in a horizontal direction of the normal scanning rate which is divided by 256. This is because the horizontal scan period of 51.2. micro-second/256=200 nano-seconds. If the addend data is "0.1" the horizontal address from the address counter 181 is incremented by "1" at every 500 nanoseconds which means that the size in the horizontal direction is multipled by 2.5 (=500 nano-seconds/200 nano-seconds when compared with the addend data of "0.25"). At a maximum enlargement it may be possible to display only one dot on the whole screen of the display. In this case "0.001" may be provided as the addend data. That is, only a ninth bit from the most significant bit of the adder 182 is set at "1". Further, when "0.5" is provided as the addend data, the address counter 181 is incremented by "1" at every 100 nanoseconds, and in this case, the size in the horizontal direction will be half (1=100 nono-seconds/200 nano-seconds) of the original size (when the addend data is "0.25"). If "1.0" is stored as the addend data, namely, if all bits in the adder are "1", the picture or character to be displayed on the screen of the display will be reduced to the minimum size when compared with the original size.

More particularly, when displaying the original size, the horizontal address of the buffer RAM 14 is incremented by "1" at every 200 nanoseconds (=51.2 microseconds/256). In other words, dot size in the horizontal direction is 200 nono-seconds for displaying the original size. The size in the horizontal direction can be enlarged or reduced by changing the displaying time of one dot in the horizontal direction by properly selecting the addend data.

If the two bits under the decimal point are "00", one dot at a time is displayed on the screen of the display. However, if the start address changes dot by dot even when enlarged by several times movements are not smooth when the image is moved gradually into view from a part to the whole as shown in FIG. 6. Accordingly, in the horizontal zoom address generator 18 shown in FIG. 5, variations of the start address are made possible at every quarter of one dot by using two bits under decimal point as the horizontal set data. For example, if the two bits under decimal point are "01", and the addend is "0.25", the start address can be changed by a quarter dot of one bit as a minimum unit. Accordingly, when displaying the emergence of an object from a screen edge step by step as shown in FIG. 6, a very smooth variation is insured.

Figure 7:
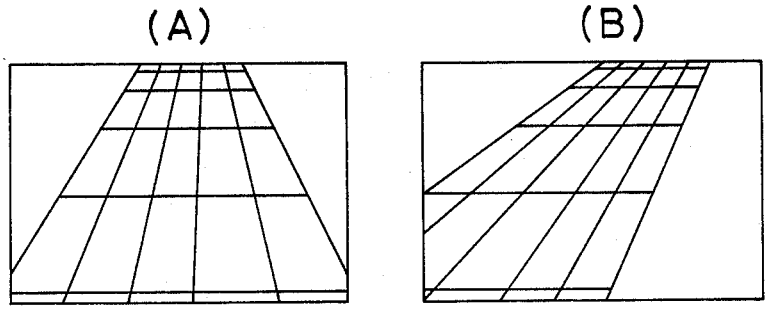
FIGS. 7A and 7B show examples of the display depicting a path in perspective.

Next, a circuit for generating a start address or a set address and a horizontal addend data for displaying an inclined path shown in FIG. 7 will be described. A displaying apparatus for displaying such a path on a screen of a display in a perspective view has been proposed hitherto. As an example of such displaying apparatus, for example, there is an apparatus disclosed U.S. Pat. No. 4,169,272 patented on Sept. 25, 1979. This prior art cited stores a start address, an end address and an addend data for one screen in a ROM and uses them as an address data for displaying a text or a background by calling successively. In the case that the path as shown in FIG. 7 is displayed in a perspective view according to the cited prior art, in the embodiment described above, the start address and addend data must be provided from the CPU 20 (FIG. 1) at every horizontal scanning. When the inclined path is fixed at certan angle the start address and addend data for one screen can be used as the set data and addend data by storing, for example, in the ROM and reading them successively. However, when a display angle or a visual point must be changed, a fixed data such as the ROM is not usable so the start address (set data) and the addend data must be calculated and provided from the CPU at every horizontal line, namely at every one horizontal blanking period. However, the horizontal blanking period is normally 13.8 micro-seconds and comparatively short it may cause excessive loads on the CPU should all data must be calculated and provided within the period thereof. Accordingly, a separate CPU must be provided for this task, as, a single CPU may not be able to operate both the calculation and processing of the game. Consequently, two CPUs must be used which is not economical.

Figure 9:
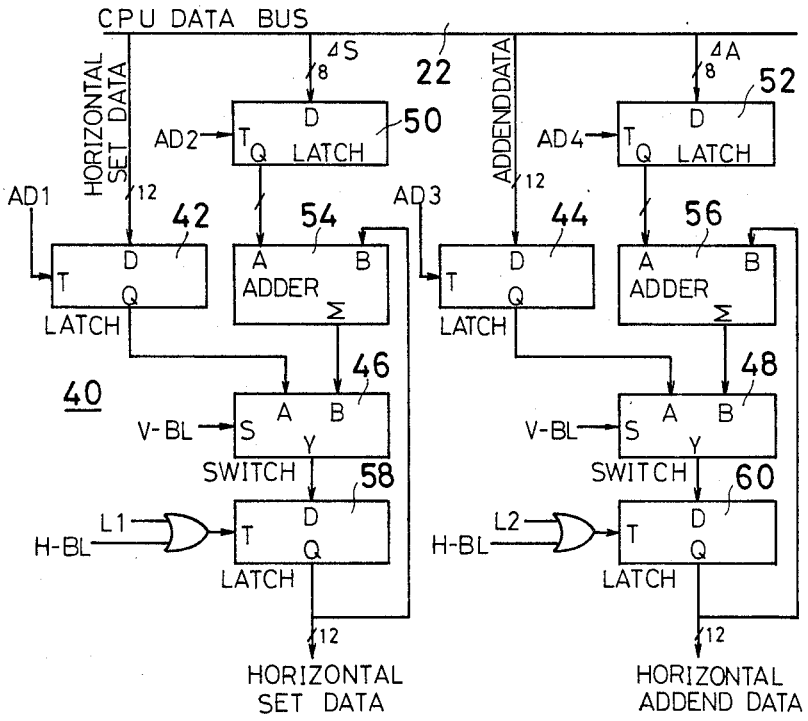
FIG. 9 is a block diagram showing a CPU interface circuit for providing data renewal at every horizontal line in accordance with FIG. 8.

Therefore, in the embodiment, a CPU interface circuit as shown in FIG. 9 is used. FIG. 9 is a circuit for providing a horizontal set data and an addend data.

Figure 8:
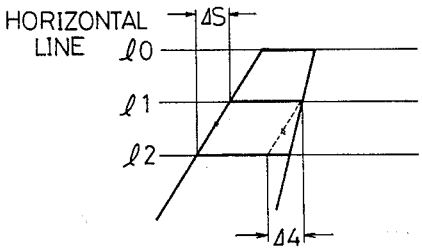
FIG. 8 is a diagram illustrating data necessary for displaying the inclined path of FIGS. 7A and 7B.

In the embodiment, a start address of a first line l0, the increment values of the set and addend data ΔS and ΔA (FIG. 8) thereof as provided from the CPU 20 (FIG. 1). Then these data will be processed in the interface circuit 40 and the horizontal set data and the addend data may be provided at each horizontal line.

The interface circuit 40 shown in FIG. 9 can be used, for example, as a substitute for the latch circuit 24 shown in FIG. 1. The horizontal set data is provided to the latch circuit 42 and the addend data to the latch circuit 44 from the CPU data bus 22. The horizontal set data from the latch circuit 42 is provided to one input A of the switch circuit 46 and the addend data is provided to one input A of the switch circuit 48. The data ΔS and ΔA are provided respectively to the latch circuits 50 and 52 fron the CPU via the data bus 22. The output of the latch circuit 50 is provided as one input A of the adder 54 and the output of the latch circuit 52 is provided as one input A of the adder 56. To another input B of the adder 54 an output from a latch circuit 58 is provided and to another input B of the adder 56 an output from a latch circuit 60 will be provided. A total output Σ of the adder 54 is provided to another input B of the switch circuit 46 and the total output Σ of the adder 56 is provided to another input B of the switch circuit 48. As these adders 54 and 56, for example, "74LS283" by Texas Instruments may be available. The switch circuits 46 and 48 which consist of, for example, "74LS175" by Texas Instruments are switched by a signal V-BL (FIG. 4) of the vertical blanking period respectively and outputs one input A thereof in the vertical blanking period. As a trigger signal of the latch circuit 58, a timing signal L1 and a signal H-BL in the horizontal blanking period are provided in an OR manner and as a trigger signal of the latch circuit 60 a timing signal L2 and the signal H-BL are provided in an OR manner. Moreover, the CPU 20 (FIG. 1) generates data setting timing signals AD1, AD2, AD3 and AD4 in the vertical blanking period and provides each as latch timing signals to the latch circuits 42, 50, 44 and 52.

Further, as the latch circuits 42, 44, 50, 52, 58 and 60 described above, for example, "74LS373" by Texas Instruments may be available respectively.

The horizontal set data, the increment data ΔS, the addend data and the increment data ΔA are provided from the CPU 20 via the data bus 22. Since the signals AD1–AD4 are provided in the vertical blanking period the horizontal set data, the increment value ΔS of the set data, the addend data and the increment value ΔA of the addend data are provided respectively to the latch circuit 42, the latch circuit 50, the latch circuit 44 and the latch circuit 52 in this period. Thereafter, in the same vertical blanking period the set data latched in the latch circuit 42 and the addend data latched in the latch 44 are provided respectively to the latch circuits 58 and 60 via the switch circuits 46 and 48. The latch circuits 58 and 60 store the data provided respectively in response to the timing signals L1 and L2. When the vertical blanking period ends and the horizontal scanning period starts the set data of each line are calculated and provided at every horizontal blanking period by the latch circuit 58 and the adder 54. Similarly, the addend data of each line are provided at every horizontal blanking period by the latch circuit 60 and the adder 56. Accordingly, such horizontal set data and addend data are renewed at each line and provided to the horizontal zoom address generator 18 shown in FIGS. 1 and 5.

Further, the vertical set data and addend data can be obtained by the same circuit configuration shown in FIG. 9. However, when displaying the path as shown in FIG. 7, the vertical addend data can be obtained by multiplying the horizontal addend data obtained in the circuit in FIG. 9 by four (=1024/256), namely by shifting the horizontal addend data obtained by two bits.

When some variations in the path to be displayed is required by using the interface circuit 40 the contents of the latch circuits 42, 50, 44, 52 are just needed to be rewritten by generating the data setting timing signals AD1–AD4 from the CPU in the desired vertical blanking period. The data to be rewritten then are naturally provided from the CPU 20 (FIG. 1). That is, for changing the path by the angle corresponding to the operation of operating means such as a joy stick or the like (not shown), the CPU 20 needs just to generate respective data and timing signals AD1–AD4 necessary for such variations in the vertical blanking period. Then the path in a varied perspective may be displayed as shown in FIG. 7(B).

Further, signals AD1–AD4 may as well be so called chip select signals obtained by decoding the address data from the CPU. Furthermore, the signals L1 and L2 may be generated, for example, by the differential circuit which responses to an end of the vertical blanking period, namely a leading end of the video signal.

Figure 3:
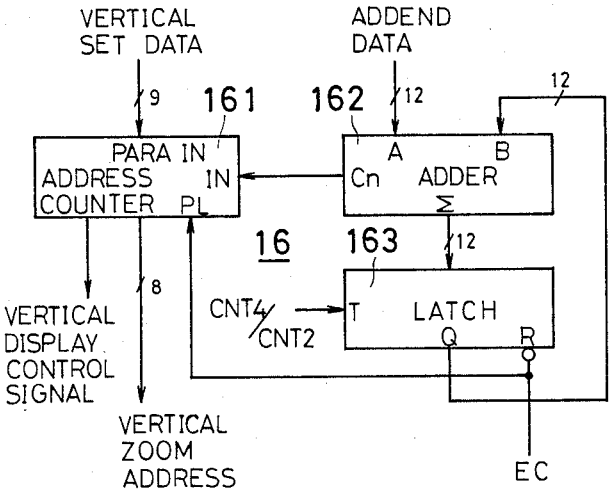
FIG. 3 is a block diagram of a vertical zoom address generator in detail.
Figure 4:
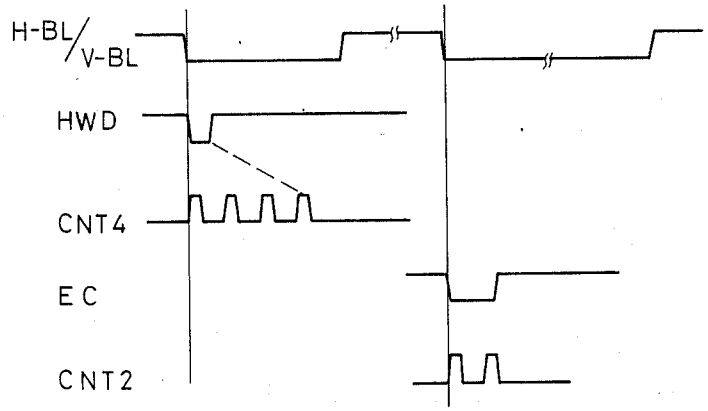
FIG. 4 is a timing diagram for illustrating various timing signals of the embodiment of FIG. 1.
Figure 5:
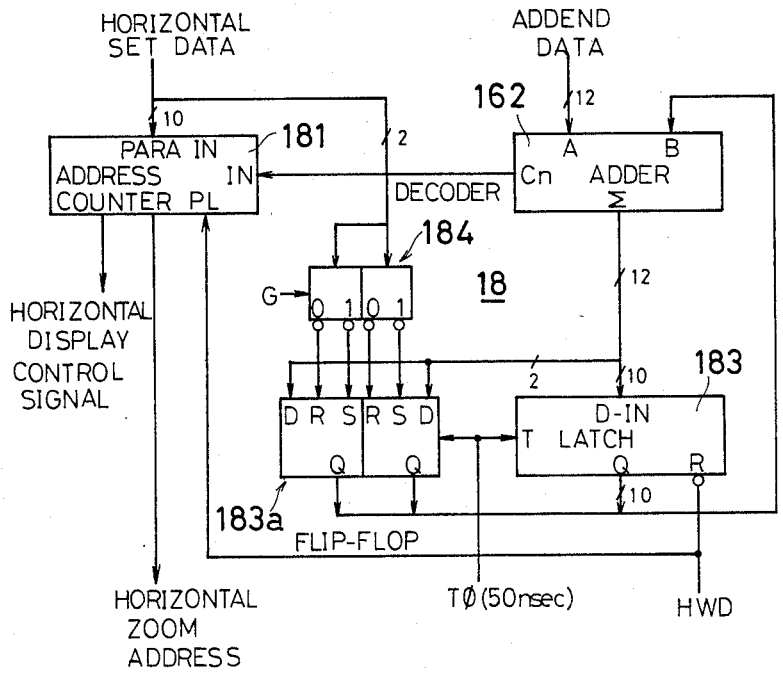
FIG. 5 is a block diagram showing a horizontal zoom address generator in detail.

As is apparent from FIGS. 3, 5 and 9, since the necessary data can be obtained by combining the adding circuit and the latch circuit, if the basic circuit of the combination thereof is constituted, for example, as a custom made large scale integrated circuit, it would be advantageous that the same integrated circuit may be used for constituting the necessary circuit even if the contents of the game have been changed.

Moreover, in the embodiment described above, the addition was used when calculating the address data. However, it is to be readily understood by those skilled in the art that subtraction or multiplication, etc. when producing the result as the addition may be equally applied in the present invention.

Although the present invention has been described and illustrated in detail, it is clearly understood that the same is by way of illustration and example only and is not to be taken as a limitation, of the present invention which is defined only by the terms of the appended claims.

What is claimed is:

1. A variable image displaying apparatus using a raster scanning type display comprising:

an addressable memory means for storing display data to be read out in a predetermined timing relationship with raster scanning of said display to produce a display image, input data means for supplying numerical data that determines image size, variable address data generating means having variable addressing increments for generating address data correlated with display data addresses stored in said memory means to output said display data, said variable address data generating means including arithmetic calculating means for digitally calculating addressing increments in response to said numerical data supplied by said input data means and in response to timing signals related to the scanning of said display, and said variable address data generating means being responsive to said arithmetic calculating means to increment addresses for addressing said memory means according to said numerical data that determines image size.

2. A displaying apparatus in accordance with claim 1, wherein said address data generating means comprises a counter means, and further comprises an initial value data setting means for setting an initial value data to said counter means.

3. A displaying apparatus in accordance with claim 2, wherein said initial value data setting means comprises a microprocessor.

4. A displaying apparatus in accordance with claim 2, wherein said initial value data setting means comprises a changing means for changing an initial value data to be set in a timing related to a scanning of said display.

5. A displaying apparatus in accordance with claim 2 wherein said numerical data supplied by said input data means to said arithmetic calculating means are prescribed numerica data, and which further comprises a prescribed numeric data setting means for setting said prescribed numeric data and for inputting same to said arithmetic calculating means.

6. A displaying apparatus in accordance with claim 5, wherein said prescribed data setting means comprises a microprocessor.

7. A displaying apparatus in accordance with claim 5, wherein said prescribed numeric data setting means comprises a changing means for changing said prescribed numeric data in a timing related to a scanning of said display.

8. A variable image displaying apparatus using a raster scanning type display comprising:

an addressable memory means for storing display data to be read out in a predetermined timing relationship with raster scanning of said display to produce a display image, variable address data generating means having changeable start address and variable addressing increments for generating display address data correlated with addresses of said memory means to output display data, initial value data means for providing initial value data defining a start position for placement of said image on the display, numerical ratio data means for providing numerical ratio data defining an enlargement or reduction ratio for determining the size that said image is to be displayed by said display, arithmetic calculating means for digitally calculating start addresses and addressing increments respectively in response to said initial value data and numerical ratio data and in response to timing signals related to scanning of said display, and said variable address data generating means being responsive to said arithmetic calculating means to vary said display address data according to said initial value data and numerical ratio data to cause variable placement and enlargement or reduction of the displayed image.

9. A displaying apparatus in accordance with claim 8, wheren said address data generating means comprises a counter means, said initial value data is set in said counter means and contents thereof are changed in accordance with calculations of said calculating means.

10. A displaying apparatus in accordance with claim 9, wherein said initial value data means and said ratio data providing means comprise a microprocessor.

11. A displaying apparatus in accordance with claim 10, which further comprises an operating means for providing operation signals to said microprocessor.

12. A displaying apparatus in accordance with claim 8, wherein said calculating means comprises a vertical data calculating means for a vertical address and a horizontal data calculating means for a horizontal address and said address data generating means comprises a vertical address generating means and a horizontal address generating means.

13. A displaying apparatus in accordance with claim 12, wherein said vertical data calculating means performs more than two calculating operations in one horizontal blanking period of said display.

14. A displaying apparatus in accordance with claim 12, wherein said vertical data calculating means comprises an adding means.

15. A displaying apparatus in accordance with claim 14, wherein said adding means of said vertical data calculating means comprises an adder in which said ratio data is provided to one input thereof and a cumulating means for cumulating an added result from said adder and providing a cumulated data to another input of said adder.

16. A displaying apparatus in accordance with claim 15, wherein said cumulating means comprises a latch circuit cooperating with said adder.

17. A displaying apparatus in accordance with claim 13 wherein said horizontal data calculating means performs a calculating operation at predetermined fixed time intervals selected to be relatively short with respect to the duration of a horizontal scan on said raster scanning type display.

18. A displaying apparatus in accordance with claim 17, wherein said horizontal data calculating means comprises an adding means.

19. A displaying apparatus in accordance with claim 18, wherein said adding means of said horizontal data calculating means comprises an adder in which said ratio data is provided to one input thereof and a cumulating means for cumulating an added result from said adder and providing cumulated data thereof to another input of said adder.

20. A displaying apparatus in accordance with claim 19, wherein said cumulating means comprises a latch circuit cooperating with said adder.

21. A displaying apparatus in accordance with claim 19, wherein said ratio data providing means provides ratio data to said vertical data calculating means that is the same as ratio data provided to said horizontal data calculating means.

22. A displaying apparatus for varying an image displayed on a raster scanning type display comprising:

an addressable memory means for storing display data to be read out at a timing rate related to the raster scanning of said display to produce a display image, variable address generating means for generating address data correlated with addresses stored in said memory means to output said display data, start data means for providing an initial start address and increment thereof for respectively determining an initial start address and an increment of change thereof for each raster scan line, image size data means for providing an initial addend representing an initial image size and an increment thereof for respectively determining an initial image size and an increment of change thereof for each raster scan line, a start address calculating means responsive to said start data means and timing signals related to the raster scanning of the display for digitally calculating image start positions in accordance with said initial start address and an increment thereof, an addend calculating means responsive to said image size data means and timing signals related to the raster scanning of the display for digitally calculating changing addends that determine image size reduction or enlargement ratio in accordance with said initial addend and increment thereof, and said variable address generating means being responsive to said start address calculating means and to said addend calculating means to increment addresses for addressing said memory means according to said start input data means and said image size input data means.

23. A displaying apparatus in accordance with claim 22, wherein a start address calculating means comprises an adder in which said start address data is provided to one input thereof and a cumulating means for cumulating an added result from said adder and providing a cumulated data thereof to another input of said adder.

24. A displaying apparatus in accordance with claim 23, wherein said cumulating means comprises a latch circuit cooperating with said adder.

25. A displaying apparatus in accordance with claim 22, wherein an addend calculating means comprises an adder in which said addend data is provided to one input thereof and a cumulating means for cumulating an added result from said adder and providing a cumulated data thereof to another input of said adder.

26. A displaying apparatus in accordance with claim 25, wherein said cumulating means comprises a latch circuit cooperating with said adder.

* * * * *